US009037023B2

(12) United States Patent
Ishido

(10) Patent No.: US 9,037,023 B2
(45) Date of Patent: May 19, 2015

(54) FIXING DEVICE, IMAGE FORMING APPARATUS INCLUDING THE SAME, AND METHOD FOR CONTROLLING THE FIXING DEVICE

(71) Applicant: KYOCERA DOCUMENT SOLUTIONS INC., Osaka (JP)

(72) Inventor: Kohei Ishido, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 172 days.

(21) Appl. No.: 13/778,331

(22) Filed: Feb. 27, 2013

(65) Prior Publication Data

US 2013/0223864 A1 Aug. 29, 2013

(30) Foreign Application Priority Data

Feb. 29, 2012 (JP) ..... 2012-043033
Feb. 25, 2013 (JP) ..... 2013-034206

(51) Int. Cl.
*G03G 15/20* (2006.01)

(52) U.S. Cl.
CPC ..... *G03G 15/2078* (2013.01); *G03G 15/2035* (2013.01); *G03G 15/2039* (2013.01)

(58) Field of Classification Search
CPC ..... G03G 15/2067; G03G 15/2078; G03G 15/2071
USPC ..... 399/67, 36; 250/221, 551, 559.12, 250/559.14, 559.4, 222.1, 231.13–231.18
See application file for complete search history.

(56) References Cited

U.S. PATENT DOCUMENTS

2003/0020420 A1* 1/2003 Naito et al. ..... 318/280

FOREIGN PATENT DOCUMENTS

JP 05053473 A * 3/1993 ..... G03G 15/20
JP 08160831 A * 6/1996 ..... G03G 21/16
JP 09-076595 3/1997
JP 09212030 A * 8/1997 ..... G03G 15/20

OTHER PUBLICATIONS

Machine translation of Kosagi H05-053473 (1993).*

* cited by examiner

*Primary Examiner* — David Gray
*Assistant Examiner* — Sevan A Aydin
(74) *Attorney, Agent, or Firm* — Morgan, Lewis & Bockius LLP

(57) ABSTRACT

A fixing device includes a heating rotating member, a pressing rotating member, a motor, a fixing pressure adjustment mechanism, a control section, a motor drive section, a detecting member, and a stop control circuit. The heating rotating member heats a paper sheet. The pressing rotating member is pressed to the heating rotating member. The motor can rotate in both forward and backward directions. The fixing pressure adjustment mechanism moves a rotating member to be moved between first and second positions. The control section includes a control device, issues an instruction of voltage to be applied to the motor. The motor drive section controls the voltage to be applied to the motor. The detecting member detects that the rotating member to be moved reaches the first position. The stop control circuit stops the motor without software control when the rotating member to be moved reaches the first position.

15 Claims, 9 Drawing Sheets

FIXING DEVICE, IMAGE FORMING APPARATUS INCLUDING THE SAME, AND METHOD FOR CONTROLLING THE FIXING DEVICE

This application is based upon and claims the benefit of priority from the corresponding Japanese Patent Application No. 2012-043033 filed on Feb. 29, 2012 and Japanese Patent Application No. 2013-034206 filed on Feb. 25, 2013, the entire contents of which are incorporated herein by reference.

BACKGROUND

The present disclosure relates to a fixing device for fixing toner, an image forming apparatus including the fixing device, and a method for controlling the fixing device.

An image forming apparatus such as a copier, a multifunction peripheral, a printer, or a facsimile apparatus is equipped with a plurality of motors for driving rotating members to rotate, which includes various rollers and a photoreceptor drum. Further, conventionally, it is common to perform rotation control (operational control) of the motors by software control using a control device (processor) such as a CPU or a microcomputer. However, if runaway of a control device occurs, excessive force may be applied to a motor, a transmission portion for transmitting motor power, or a portion driven by the motor power, resulting in a breakdown. Therefore, there is known a technique to prevent runaway of a carriage (head moving portion of an ink jet printer apparatus) due to runaway of the CPU.

Specifically, there is known a carriage drive control device for a carriage drive motor for driving the carriage to move in a printer, which includes a pulse signal output unit that outputs a pulse signal whose number of pulses is proportional to a movement amount of the carriage, a control unit that output a control signal for controlling the carriage drive motor by feedback control using the pulse signal received from the pulse signal output unit so as to make a predetermined speed pattern including acceleration, constant speed, and deceleration, a carriage driving circuit that drives the carriage drive motor on the basis of the control signal received from the control unit, and a pulse period detection circuit constituted of a hardware logic circuit that detects a pulse period of the pulse signal received from the pulse signal output unit and compares the detected pulse period with a lower limit value having a predetermined set pulse period, so as to output a stop instruction signal for instructing the carriage driving circuit to forcedly stop the carriage drive motor when the detected pulse period becomes smaller than the lower limit value.

First, an electrophotography type image forming apparatus is equipped with a fixing device for fixing a toner image transferred onto a paper sheet. For instance, the fixing device includes a heating rotating member (for example, a roller) which is heated by a heat generating member so as to heat toner, and a pressing rotating member (for example, a roller) which is pressed to the heating rotating member. A paper sheet onto which a toner image is transferred is permitted to pass through a nip between the heating rotating member and the pressing rotating member, and hence the fixing process is performed.

Further, in the case where the heating rotating member and the pressing rotating member always contact with each other, there are demerits such as that it is difficult to remove a jammed paper sheet in the nip and that lifetime of the rotating member is shortened. Therefore, the fixing device may include a mechanism for decreasing fixing pressure by separating the heating rotating member from the pressing rotating member during interval between printing processes, while permitting the heating rotating member and the pressing rotating member to be close to each other for making a pressed state (contact state) with pressure (fixing pressure) of the nip in the printing process.

In this mechanism, a motor may be used as a drive source for moving the rotating member. Further, conventionally, a sensor for detecting a position of the rotating member or a rotation angle of the motor is disposed so that a control device such as a CPU for controlling rotation of the motor receives an output of the sensor, the control device recognizes a position of the rotating member or a state of the motor, and hence a rotation direction, a rotation angle, and stop of the motor are controlled by software control.

However, if the control device such as the CPU runs away, the motor drive is continued (locked state is continued) even if the rotating member becomes a limit position. Therefore, the motor or a component such as a gear included in the mechanism for moving the rotating member may be broken down. In addition, when adopting a structure in which the control device performs software control of the motor, a CPU port for receiving the output of the sensor may be lacking, or wiring may be complicated. In addition, it is necessary to install software for the control. In this way, there is a demerit due to the structure in which the control device such as the CPU receives the output of the sensor so as to perform software control.

Here, the above-mentioned known carriage drive control device is a device related to movement of the carriage and is not related to adjustment of the fixing pressure of the fixing device. In addition, the device cannot be used without a thing for generating a pulse in accordance with motor rotation (for example, an encoder). In addition, a high accuracy encoder is expensive, and hence there is a demerit that manufacturing cost increases.

SUMMARY

The present disclosure is made in view of the above-mentioned problems of the conventional technique, and it is an object thereof to cancel the demerit due to the structure in which the control device such as the CPU performs software control, in which the output of the sensor is supplied to a stop control circuit for controlling to stop the motor as hardware, instead that the control device such as the CPU controls to stop the motor by software control like the conventional structure, so as to safely stop the motor even if the control device such as the CPU runs away.

In order to solve the above-mentioned problems, a fixing device according to a first aspect of the present disclosure includes a heating rotating member, a pressing rotating member, a motor, a fixing pressure adjustment mechanism, a control section, a motor drive section, a detecting member, and a stop control circuit. The heating rotating member heats the paper sheet onto which toner is transferred. The pressing rotating member is pressed to the heating rotating member so as to form a nip. The motor can rotate in both forward and backward directions. The fixing pressure adjustment mechanism is driven by the motor so as to move a rotating member to be moved that is one of the pressing rotating member and the heating rotating member, in accordance with a rotation direction of the motor between predetermined first and second positions in a pressure increasing direction or in a pressure decreasing direction, and hence a fixing pressure that is a pressure of the nip is adjusted. The control section includes a control device, which issues an instruction of voltage to be applied to the motor in accordance with the rotation direction of the motor by software control. The motor drive section controls the voltage to be applied to the motor on the basis of the instruction from the control section. The detecting member detects that the rotating member to be moved that has been moved by the fixing pressure adjustment mechanism reaches a first position so that the control device does not receive the output. The stop control circuit receives an output of the detecting member and stops the motor without software control when the detecting member detects that the rotating member to be moved reaches the first position.

In addition, in order to solve the above-mentioned problems, a method for controlling a fixing device according to a second aspect of the present disclosure includes the steps of permitting the heating rotating member to heat a paper sheet onto which toner is transferred, pressing a pressing rotating member to the heating rotating member so as to form a nip, moving a rotating member to be moved that is one of the heating rotating member and the pressing rotating member, between predetermined first and second positions in a pressure increasing direction and in a pressure decreasing direction, on the basis of driving a motor that can rotate in forward and backward directions, in accordance with a rotation direction of the motor, so as to permit the fixing pressure adjustment mechanism to adjust a fixing pressure that is a pressure of the nip, permitting a control section including a control device to issue an instruction of a voltage to be applied to the motor by software control in accordance with the rotation direction of the motor, permitting the motor drive section to control the voltage to be applied to the motor on the basis of the instruction from the control section, inhibiting an output of a detecting member for detecting that the rotating member to be moved that has been moved by the fixing pressure adjustment mechanism reaches the first position from being received by the control device, supplying the output of the detecting member to the stop control circuit, and permitting the stop control circuit to stop the motor without software control, when the detecting member detects that the rotating member to be moved reaches the first position.

Further features and advantages of the present disclosure will become apparent from the description of embodiments given below.

DETAILED DESCRIPTION

Hereinafter, with reference to FIGS. 1 to 13, an image forming apparatus including a fixing device 1 according to the present disclosure is described. In the following description, a printer 100 is exemplified as the image forming apparatus. However, elements such as a structure and layout described in each embodiment are merely examples for description and should not be interpreted to limit the scope of the disclosure.

(Outline of Image Forming Apparatus)

Figure 1:
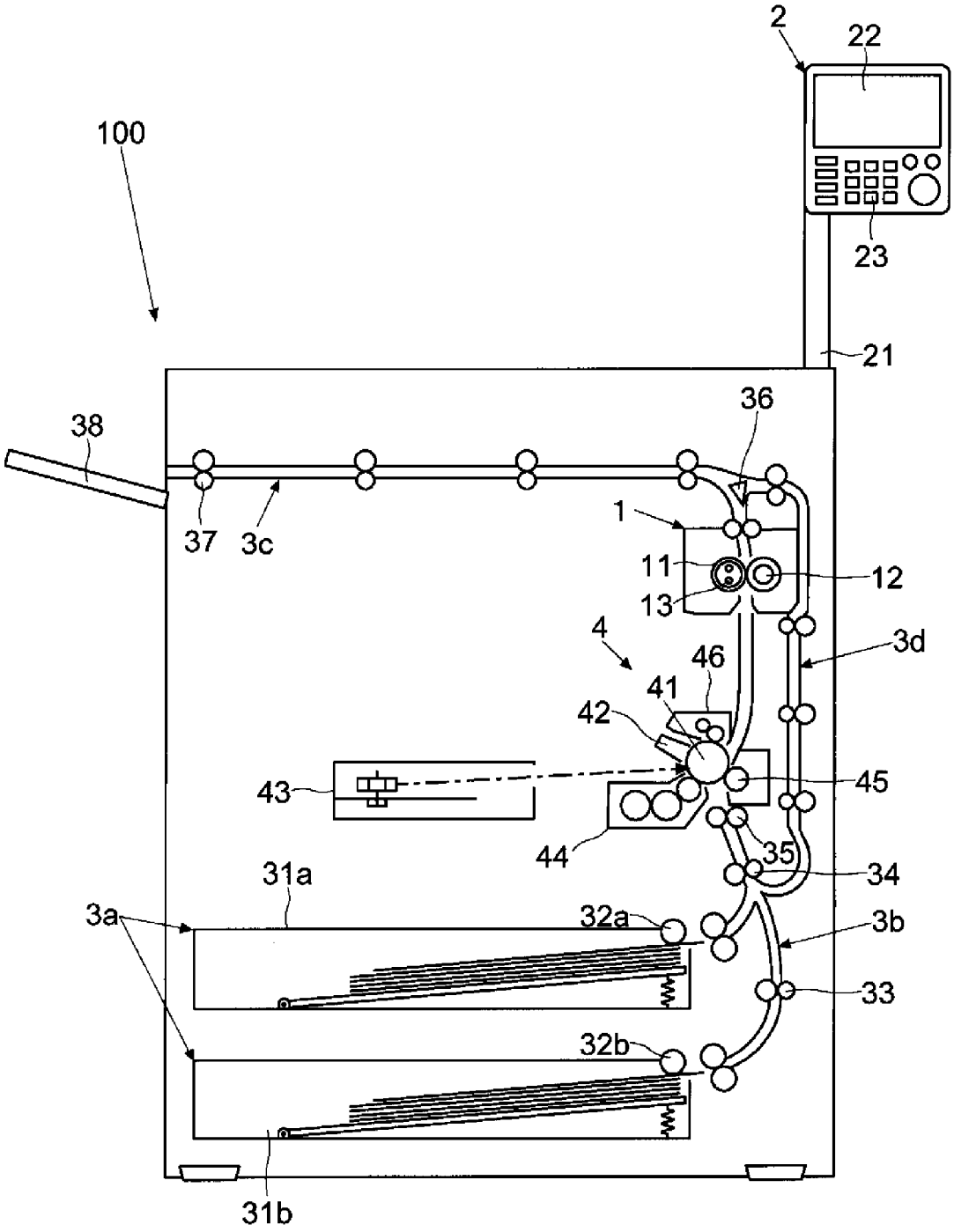
FIG. 1 is a schematic cross-sectional front view illustrating an outline structure of a printer.

First, with reference to FIG. 1, an outline of the image forming apparatus according to an embodiment is described. FIG. 1 is a schematic cross-sectional front view illustrating an outline structure of the printer 100.

As illustrated in FIG. 1, the printer 100 of this embodiment includes an operation panel 2 attached to a side thereof Further, inside the printer 100, there are disposed a paper sheet feeder 3*a*, a first transport portion 3*b*, an image forming portion 4, the fixing device 1, and a second transport portion 3*c*.

First, as illustrated in FIG. 1, the operation panel 2 is disposed on a distal end of an arm 21 disposed on the upper right side of the printer 100. Further, the operation panel 2 includes a display portion 22 (for example, a liquid crystal panel) which displays screens for states of the printer 100, various messages, and settings. The display portion 22 is a touch panel type display. In addition, the display portion 22 is equipped with a plurality of keys 23 for setting and input. For instance, the operation panel 2 accepts user's setting of print conditions such as type and size of the paper sheet to be used for printing. In addition, the operation panel 2 displays states and errors of the printer 100, for example, so as to inform the user.

As illustrated in FIG. 1, the paper sheet feeder 3*a* is disposed in the lower part of the printer 100. The paper sheet feeder 3*a* includes a plurality of cassettes 31*a* and 31*b*. For instance, each cassette 31 stores various types of paper sheets such as copy paper sheets, OHP sheets, or label paper sheets. Each cassette 31 is equipped with a paper feed roller 32 driven to rotate by a drive mechanism (not shown) including a motor and the like (In FIG. 1, an upper roller is denoted by 32*a*, and a lower roller is denoted by 32*b*). The paper feed roller 32 rotates so as to feed the paper sheet to the first transport portion 3*b*.

Further, the first transport portion 3*b* transports the paper sheet in the printer 100. The first transport portion 3*b* guides the paper sheet supplied from the paper sheet feeder 3*a* to the image forming portion 4. The first transport portion 3*b* is equipped with a pair of transport rollers 33 and 34, and a registration roller pair 35 which keeps the transported paper sheet to wait before the image forming portion 4 (transfer roller 45) and sends out the same in synchronization with timing.

The image forming portion 4 forms a toner image on the basis of image data of the image to be formed and transfers the toner image onto the paper sheet. Specifically, the image forming portion 4 includes a photoreceptor drum 41, and a charging portion 42, an exposing portion 43, a developing portion 44, the transfer roller 45, and a cleaning portion 46, which are disposed around the photoreceptor drum 41.

The photoreceptor drum 41 includes a photosensitive layer on the outer circumference surface, carries a toner image on the circumference surface, and is driven to rotate at a predetermined process speed. The charging portion 42 charges the photoreceptor drum 41 at a constant potential. The exposing portion 43 outputs a laser beam (illustrated by a dashed dotted line) on the basis of an input image signal (image data), which scans and exposes the photoreceptor drum 41 after being charged. Thus, an electrostatic latent image is formed on the surface of the photoreceptor drum 41.

The developing portion 44 supplies toner to the photoreceptor drum 41 and develops the electrostatic latent image formed on the circumference surface of the photoreceptor drum 41. The cleaning portion 46 cleans the photoreceptor drum 41. The transfer roller 45 is pressed to the photoreceptor drum 41. Further, the registration roller pair 35 sends the paper sheet to the nip between the photoreceptor drum 41 and the transfer roller 45 in accordance with the formed toner image. Then, a predetermined voltage for transferring is applied to the transfer roller 45. Thus, the toner image is transferred onto the paper sheet.

The fixing device 1 is disposed on a downstream side of the image forming portion 4 in a paper sheet transport direction. The fixing device 1 heats and presses the toner image transferred onto the paper sheet so as to fix the same. Further, the fixing device 1 includes mainly a heating roller 11 (corresponding to a heating rotating member) heated by a heater 13, a pressing roller 12 (corresponding to a pressing rotating member or a rotating member to be moved). Then, when the paper sheet onto which the toner image is transferred passes through the nip between the heating roller 11 and the pressing roller 12, it is heated and pressed. As a result, the toner image is fixed to the paper sheet. Note that the paper sheet after the fixing is directed to the second transport portion 3*c* disposed above the fixing device 1.

For instance, the circumference surface of the heating roller 11 has a tube-like or sleeve-like shape made of a metal (for example, aluminum or iron). For instance, the heater 13 is embedded in the heating roller 11. The heater 13 may be anyone that can electrically heat the heating roller 11. For instance, a halogen heater, an electric heating wire, or an induction heater may be used as the heater for the heating roller 11. On the other hand, the pressing roller 12 is a roller having an elastic layer on the circumference surface, which is deformed in accordance with the shape of the heating roller 11. For instance, the elastic layer is made of resin such as silicon sponge.

The paper sheet discharged from the fixing device 1 is transported via the second transport portion 3*c* extending substantially horizontally from a branch portion 36 to the left side surface of the printer 100 and is discharged to a discharge tray 38 disposed on the upper outside of the left side surface of the printer 100 by a discharge roller pair 37. Thus, an image forming process of one sheet is finished. Note that when double-sided printing is performed, the paper sheet discharged from the fixing device 1 is temporarily sent out from the branch portion 36 toward the discharge tray 38, and then the transport direction is switched back toward the right side surface of the printer 100. Then, the paper sheet passes through the branch portion 36, is sent downward via a double-sided printing transport portion 3*d*, and is sent again to the upstream side of the registration roller pair 35 via the first transport portion 3*b*.

(Hardware Structure of Printer 100)

Figure 2:
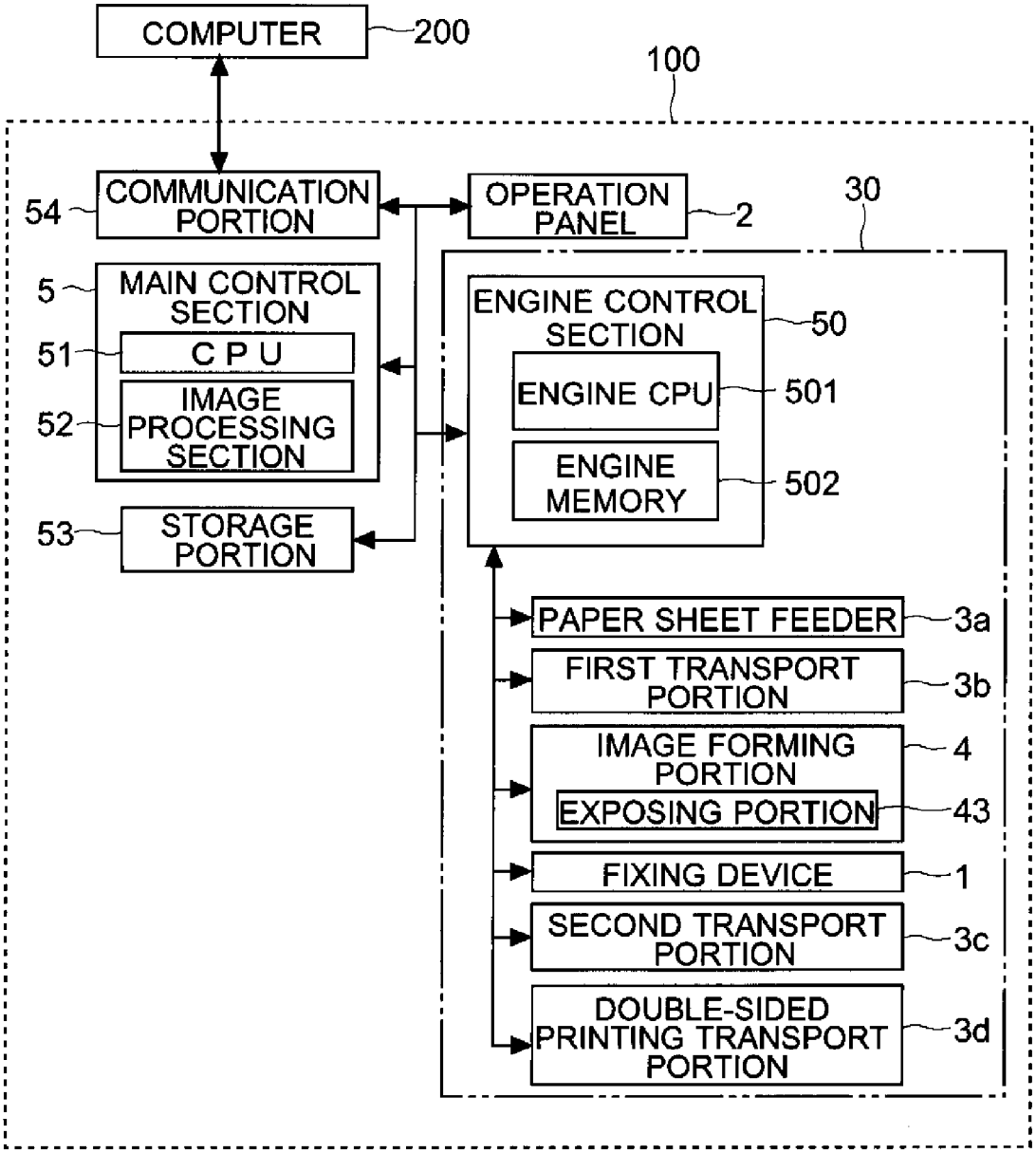
FIG. 2 is a block diagram illustrating an example of a hardware structure of the printer.

Next, with reference to FIG. 2, a hardware structure of the printer 100 according to the embodiment is described. FIG. 2 is a block diagram illustrating an example of a hardware structure of the printer 100.

As illustrated in FIG. 2, the printer 100 according to this embodiment includes a main control section 5 disposed inside. For instance, the main control section 5 includes a CPU 51 for performing various types of operation processings and signal processings, and an image processing section 52 for performing image processing on image data. The main control section 5 controls the CPU 51 and the image processing section 52 to perform various processings, controls individual portions of the printer 100, and performs general control.

The CPU 51 performs control of the individual portions of the printer 100 and calculation on the basis of a control program, control data, and setting data that are stored in a storage portion 53 and is loaded. The storage portion 53 is constituted of a combination of nonvolatile and volatile storage devices such as a ROM, a RAM, a flash ROM, and an HDD. For instance, the storage portion 53 stores the control program and the control data of the printer 100.

In addition, the main control section 5 is connected to the operation panel 2 and recognizes setting with the operation panel 2. In addition, the main control section 5 controls the display portion 22 of the operation panel 2 to display information indicating a state of the printer 100 such as an error or an abnormal state.

In addition, the main control section 5 is connected to a communication portion 54. The communication portion 54 is a communication interface for performing communication with a computer 200 (for example, a personal computer or a server) to be a transmission source of print data containing image data to be printed, and setting data concerning setting for printing via a network, a cable, or a public line. The communication portion 54 receives print data from the computer 200.

The image processing section 52 performs various types of image processings such as expansion, reduction, rotation, density conversion, data format conversion on the image data received from the computer 200 in accordance with the setting data or setting by the operation panel 2. Then, when a print job is performed, the image processing section 52 sends the image data after the image processing to the exposing portion 43. The exposing portion 43 receives the image data and performs scanning and exposure.

In addition, the printer 100 is equipped with an engine control section 50 (corresponding to control section) for controlling a portion concerning printing (engine portion 30). The main control section 5 is connected to the engine control section 50 so as to communicate with the same. Further, when printing is performed, the main control section 5 issues an instruction to the engine control section 50 to perform printing with data indicating print content. Note that the engine control section 50 is disposed as an example in this description, but it is possible to integrate the main control section 5 and the engine control section 50 so that the main control section 5 controls the engine portion 30.

The engine control section 50 is connected to a printing portion (engine portion 30) including the paper sheet feeder 3*a*, the first transport portion 3*b*, the image forming portion 4, the fixing device 1, the second transport portion 3*c*, the double-sided printing transport portion 3*d*, and the like, so that communication can be performed between them. The engine control section 50 controls action of the engine portion 30 to perform printing. Further, the engine control section 50 is equipped with an engine CPU 501 (corresponding to the control device) for performing control as for printing.

The engine CPU 501 performs software control of action of the portion such as the paper sheet feeder 3*a*, the first transport portion 3*b*, the image forming portion 4, the fixing device 1, the second transport portion 3*c*, and the double-sided printing transport portion 3*d* on the basis of data and a program stored in an engine memory 502 disposed in the engine control section 50. In addition, the engine CPU 501 receives inputs of various sensors disposed in the printer 100 and recognizes a state of the printer 100. Note that the engine memory 502 is constituted of a ROM and a RAM, for example.

(Outline of Structure of Fixing Device 1)

Figure 3:
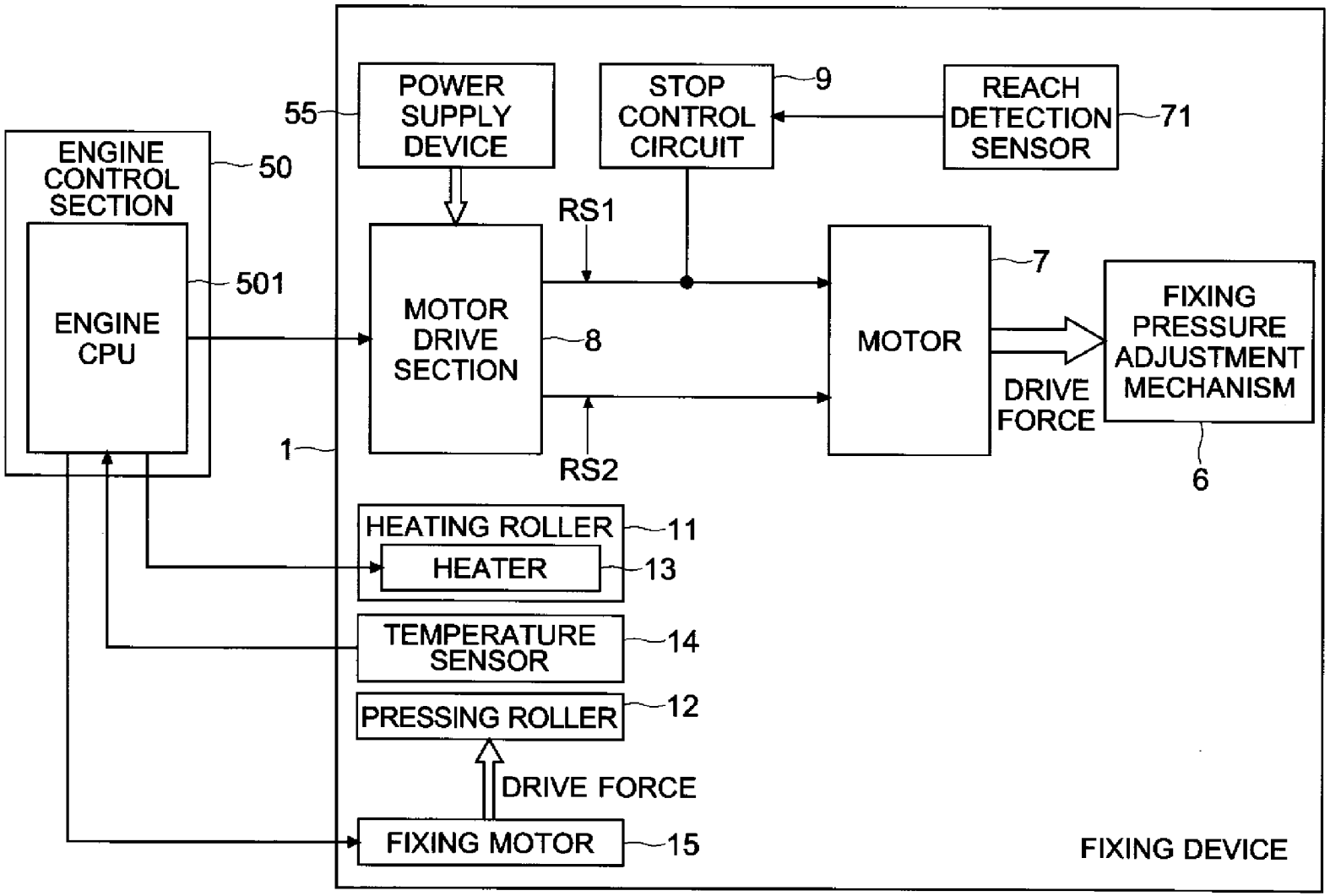
FIG. 3 is a block diagram illustrating an example of a fixing device.

Next, with reference to FIG. 3, an outline of the fixing device 1 according to this embodiment is described. FIG. 3 is a block diagram illustrating an example of the fixing device 1.

As described above with reference to FIGS. 1 and 2, the printer 100 includes the fixing device 1. Further, as described above with reference to FIG. 1, the fixing device 1 includes the heating roller 11 and the pressing roller 12 for fixing the paper sheet on which the toner image is transferred. The fixing is performed by permitting the paper sheet on which the toner image is transferred to pass through the nip between the heating roller 11 and the pressing roller 12.

The engine control section 50 (engine CPU 501) controls power supply to the heater 13 for heating the heating roller 11. Further, a temperature sensor 14 is disposed so as to contact (or not to contact) with the heating roller 11. The temperature sensor 14 includes a thermistor, and an output value (for example, a voltage value) changes in accordance with temperature of the heating roller 11. The engine control section 50 (engine CPU 501) recognizes the heating roller 11 on the basis of an output of the temperature sensor 14. Further, the engine control section 50 controls ON/OFF of power supply to the heater 13 and output of the heater 13 so that temperature of the heating roller 11 becomes a predetermined fixing control temperature (appropriate temperature for fixing the toner, which is approximately 170 degrees Celsius, for example).

In addition, the engine control section 50 controls action of a fixing motor 15 for rotating the heating roller 11 and the pressing roller 12. The engine control section 50 (engine CPU 501) rotates the fixing motor 15 in the printing process or in a warm-up process in which the heating roller 11 at a temperature below the fixing control temperature is heated up to the fixing control temperature. Thus, the heating roller 11 and the pressing roller 12 are rotated. For instance, a driving force of the fixing motor 15 is transmitted to the heating roller 11 (or to the pressing roller 12). Because the heating roller 11 and the pressing roller 12 contact with each other, rotation of one of them causes following rotation of the other. Note that the driving force of the fixing motor 15 may be transmitted to both the heating roller 11 and the pressing roller 12 so that the heating roller 11 and the pressing roller 12 are rotated.

(Adjust of Fixing Pressure)

Figure 4:
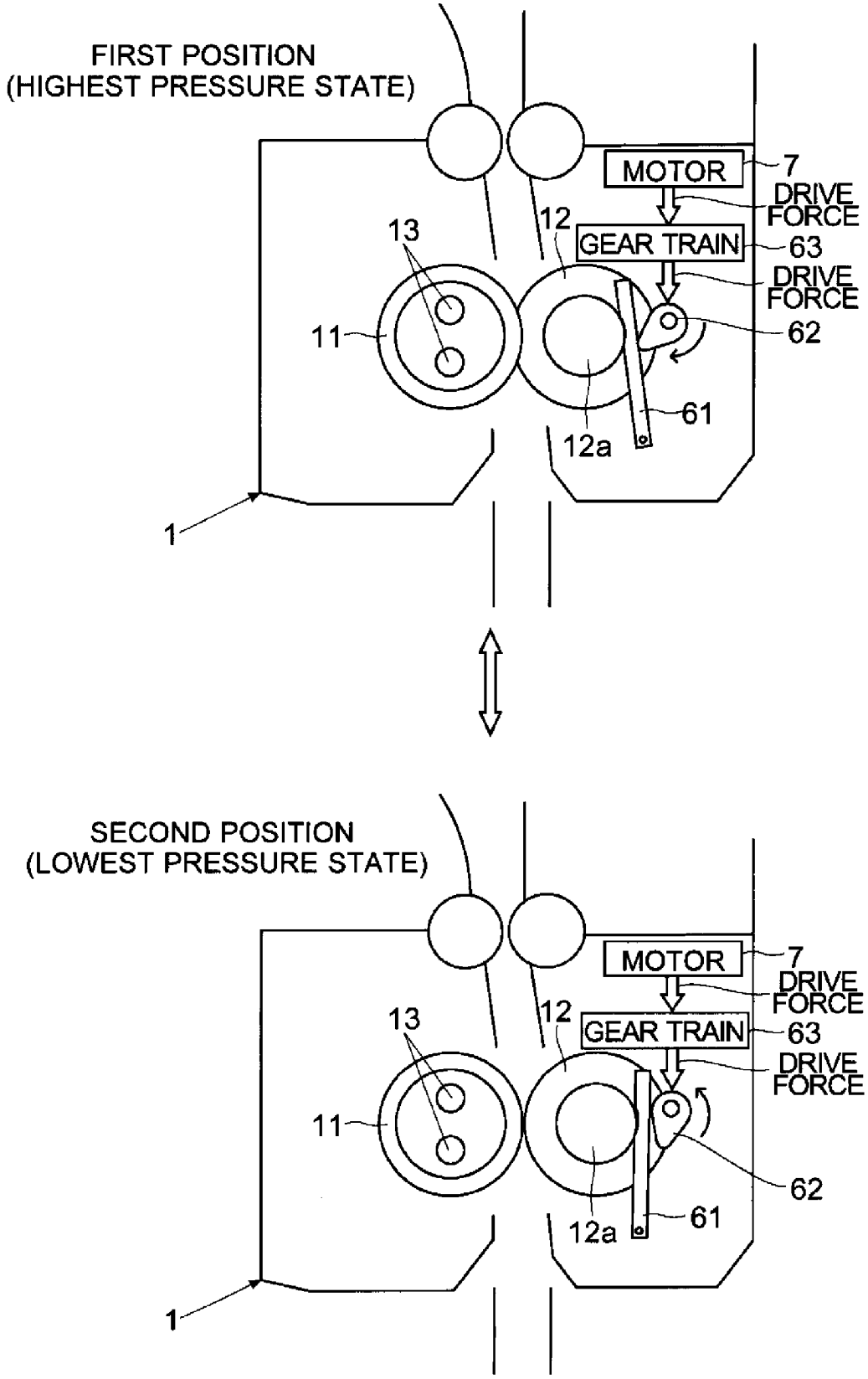
FIG. 4 is an explanatory diagram illustrating an example of a fixing pressure adjustment mechanism.
Figure 5:
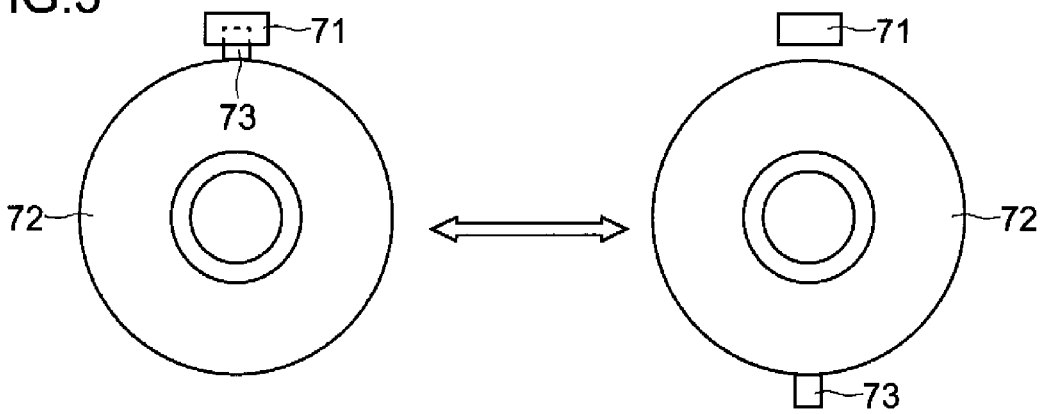
FIG. 5 is an explanatory diagram illustrating an example of a sensor for detecting that a first position (highest pressure position) is reached.
Figure 6:
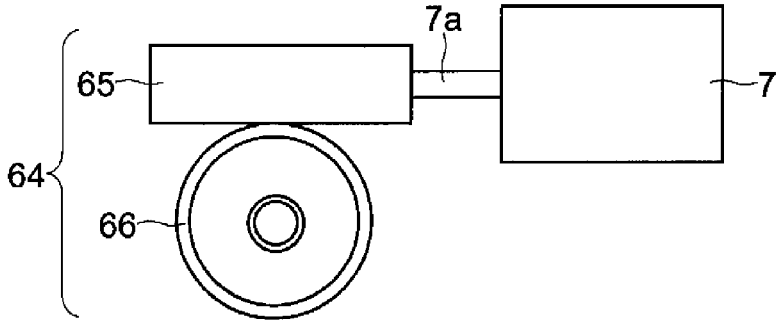
FIG. 6 is an explanatory diagram illustrating an example of a worm gear included in a gear train of the fixing pressure adjustment mechanism.
Figure 7:
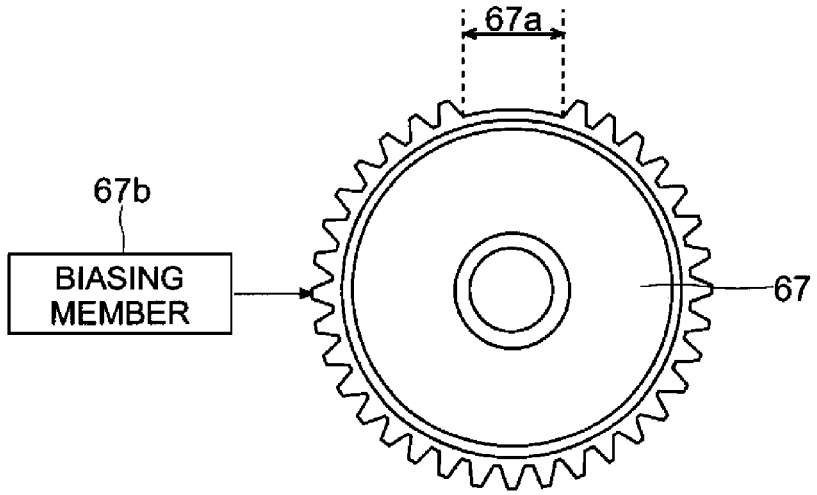
FIG. 7 is an explanatory diagram illustrating an example of a tooth-lacking gear.

Next, with reference to FIGS. 3 to 7, adjustment of the fixing pressure in the fixing device 1 according to the embodiment is described. FIG. 4 is an explanatory diagram of an example of a fixing pressure adjustment mechanism 6. FIG. 5 is an explanatory diagram illustrating an example of a sensor for detecting that a first position (highest pressure position) is reached. FIG. 6 is an explanatory diagram illustrating an example of a worm gear 64 included in a gear train 63 of the fixing pressure adjustment mechanism 6. FIG. 7 is an explanatory diagram of an example of a tooth-lacking gear 67.

The fixing device 1 of this embodiment is equipped with a fixing pressure adjustment mechanism 6 for moving a position of the pressing roller 12 with respect to the heating roller 11 so as to adjust the fixing pressure (a nip pressure between the heating roller 11 and the pressing roller 12). Note that an example of moving the pressing roller 12 is described in this embodiment, but it is possible to move the heating roller 11 instead of the pressing roller 12 so as to adjust the fixing pressure. Further, as illustrated in FIG. 3, the fixing pressure adjustment mechanism 6 receives the driving force generated by a motor 7 so as to move the position of the pressing roller 12.

For instance, the motor 7 is a DC brush motor that can rotate in forward and backward directions. Further, the fixing device 1 is equipped with a motor drive section 8 for controlling voltage applied to the motor 7 (a voltage value and a current direction between terminals 74*a* and 74*b* of the motor 7) so as to control the rotation direction and rotation time of the motor 7. The motor drive section 8 and the motor 7 are connected to each other via a first signal line RS1 and a second signal line RS2 (details thereof will be described later). The motor drive section 8 rotates the motor 7 in the direction corresponding to the instruction from the engine control section 50 (engine CPU 501). In addition, the motor drive section 8 controls supply and cut-off of power supply to the motor 7 from a power supply device 55 for generating DC voltage for rotating the motor from AC electric power supplied from a commercial power supply. The power supply device 55 is a power conversion circuit including a rectifying circuit, a smoothing circuit, and a transformer. The power supply device 55 generates a DC voltage (for example, DC 24 V) to be supplied to various motors including the motor 7.

The fixing pressure adjustment mechanism 6 moves the pressing roller 12 in the direction toward the heating roller 11 in the printing process or in the warm-up process. Then, the fixing pressure adjustment mechanism 6 moves the pressing roller 12 to a position to be a highest fixing pressure (fixing pressure for printing as specified) predetermined appropriately for fixing the toner image. In the following description, the state where the fixing pressure becomes the highest fixing pressure (the fixing pressure becomes a predetermined value) is referred to as a "highest pressure state".

On the other hand, if the pressing roller 12 is pressed to the heating roller 11 for long period of time because the printing is not performed for long period of time, a specific part of the pressing roller 12 is deformed (to be concave) for long period of time. Then, the pressing roller 12 may be damaged easily. Therefore, in order to achieve a longer lifetime of the pressing roller 12, the fixing pressure adjustment mechanism 6 moves the pressing roller 12 in the direction separating from the heating roller 11 to the position to be the lowest fixing pressure predetermined as a reduced fixing pressure during a period from end of the printing to start of the next printing. In the following description, the state where the fixing pressure becomes the lowest fixing pressure (the fixing pressure becomes lowest) is referred to as a "lowest pressure state". Note that the heating roller 11 and the pressing roller 12 contact with each other even in the lowest pressure state.

Then, in the following description, for convenience sake, the position of the pressing roller 12 in the highest pressure state is referred to as the first position, and the position of the pressing roller 12 in the lowest pressure state is referred to as the second position. In other words, the fixing pressure adjustment mechanism 6 moves the pressing roller 12 between the first position (highest pressure state) and the second position (lowest pressure state).

With reference to FIG. 4, an example of the fixing pressure adjustment mechanism 6 is described. For instance, the fixing pressure adjustment mechanism 6 includes a contact plate 61 contacting with a rotation shaft 12*a* of the pressing roller 12, a cam 62, and the gear train 63 including a plurality of gears. On one end of the contact plate 61, there is disposed a fulcrum. Then, the contact plate 61 can swing so as to shake the other end without a fulcrum. In addition, the rotation shaft 12*a* of the pressing roller 12 contacts with one surface of the contact plate 61, and the cam 62 contacts with the other surface.

Then, in FIG. 4, the upper diagram illustrates the highest pressure state (in which the pressing roller 12 is in the first position), and the lower diagram illustrates the lowest pressure state (in which the pressing roller 12 is in the second position). When the motor 7 is rotated so that the cam 62 rotates in an arrow direction illustrated in the upper diagram of FIG. 4, the driving force is transmitted to the cam 62 via the gear train 63 so that the cam 62 is rotated. Then, the cam 62 moves the contact plate 61 and the pressing roller 12 contacting with the same in the direction toward the heating roller 11. When the motor 7 is rotated so that the cam 62 rotates in an arrow direction illustrated in the lower diagram of FIG. 4, the driving force is transmitted to the cam 62 via the gear train 63 so that the cam 62 is rotated. Then, the cam 62 decreases the force to move the contact plate 61 and the pressing roller 12 contacting with the same in the direction toward the heating roller 11. Thus, the pressing roller 12 moves back in the pressure decreasing direction of the fixing pressure by resilience force thereof so as to move in the direction separating from the heating roller 11.

Note that there is described an example in which the cam 62 is used for adjusting the fixing pressure in this embodiment, but it is possible to use a mechanism other than the cam 62 to move the pressing roller 12 or the heating roller 11 for adjusting the fixing pressure.

Then, as illustrated in FIGS. 3 and 5, the fixing device 1 of this embodiment is equipped with a reach detection sensor 71 (corresponding to the detecting member) for detecting that the pressing roller 12 becomes the first position (in the highest pressure state). The reach detection sensor 71 of this embodiment is a transparent type optical sensor. Further, one gear in the gear train 63 included in the fixing pressure adjustment mechanism 6 is provided with a metal plate 72 having a protrusion 73. The reach detection sensor 71 is disposed to this metal plate 72.

The gear with the metal plate 72 is driven to rotate by the motor 7. Further, the metal plate 72 is attached to the gear so that the protrusion 73 of the metal plate 72 blocks an optical path between a light emission portion NT1 and a light reception portion NT2 of the reach detection sensor 71 (see FIG. 8) when the pressing roller 12 becomes the first position (in the highest pressure state). In other words, gear ratios and attachment angles of gears included in the gear train 63 are set so that the protrusion 73 of the metal plate 72 blocks an optical path between the light emission portion NT1 and the light reception portion NT2 of the reach detection sensor 71 (see FIG. 8) when the pressing roller 12 becomes the first position (in the highest pressure state). Therefore, an output of the reach detection sensor 71 is different between the state where the pressing roller 12 is in the first position (in the highest pressure state) and the state where the same is not in the first position. Thus, it is possible to detect whether or not the pressing roller 12 is in the first position (in the highest pressure state).

Then, as illustrated in FIG. 3, the output of the reach detection sensor 71 is supplied to a stop control circuit 9 for stopping the motor 7 instead of the engine control section 50 (engine CPU 501) in this embodiment (details of the stop control circuit 9 will be described later). Thus, without using software control by the control device (engine CPU 501), it is possible to stop the motor 7 when the pressing roller 12 becomes the first position (in the highest pressure state).

In addition, as illustrated in FIG. 6, the worm gear 64 is disposed in the gear train 63 of the fixing pressure adjustment mechanism 6. For instance, as illustrated in FIG. 6, a worm 65 is attached to a shaft 7*a* (output rotation shaft) of the motor 7. Further, a worm wheel 66 engages with the worm 65. Thus, the driving force of the motor 7 is transmitted to the cam 62. On the other hand, unless the motor 7 turns in reverse, the worm gear 64 does not reversely rotate even if a rotation force is generated in the worm wheel 66 side (cam 62 side). Therefore, while the motor 7 is stopped, even if a force to move the cam 62 (for example, a force to move the pressing roller 12 from the first position toward the second position) is applied, the motor 7 does not rotate, and hence the position of the pressing roller 12 is not changed.

Further, as illustrated in FIG. 7, the tooth-lacking gear 67 is disposed in the gear train 63 of the fixing pressure adjustment mechanism 6. The tooth-lacking gear 67 is a gear having teeth on the circumference, a part of which are lacking. When the engaging gear (for transmitting the driving force to the tooth-lacking gear 67) rotates to reach a tooth-lacking part 67*a*, it idles. In the idling state, the driving force is not transmitted to the tooth-lacking gear 67 and the following stage.

Further, in the gear train 63 of the fixing pressure adjustment mechanism 6 of this embodiment, the tooth-lacking gear 67 is incorporated in the gear train 63 so that the teeth of the gear for transmitting the driving force from the motor 7 to the tooth-lacking gear 67 faces the tooth-lacking part 67*a* when the pressing roller 12 becomes the second position (in the lowest pressure state). In other words, when the pressing roller 12 becomes the second position (in the lowest pressure state), it idles so that the driving force is not transmitted. Therefore, gear ratios and attachment angles of gears such as the tooth-lacking gear 67 included in the gear train 63 are set so that the idling state occurs due to the tooth-lacking gear 67 when the pressing roller 12 becomes the second position (in the lowest pressure state). Thus, when the pressing roller 12 becomes the second position (in the lowest pressure state), the cam 62 automatically stops, and hence the movement of the pressing roller 12 is stopped.

Note that a biasing member 67*b* (for example, a spring) is linked (disposed) to the tooth-lacking gear 67 so that the tooth-lacking gear 67 rotating in the pressure increasing direction engages with the gear for transmitting the driving force from the motor 7 to the tooth-lacking gear 67 when the motor 7 is rotated in the pressure increasing direction for changing the lowest pressure state to the highest pressure state (for increasing the pressure). The biasing member 67*b* is disposed so that the tooth-lacking gear 67 rotates toward the downstream side in the rotation direction of the tooth-lacking gear 67 when the pressing roller 12 is moved in the direction toward the heating roller 11 (for increasing the pressure). When the pressing roller 12 is moved away in the direction toward the heating roller 11 (for decreasing the pressure), the biasing member 67*b* biases toward the upstream side in the rotation direction of the tooth-lacking gear 67. Therefore, the tooth-lacking gear 67 is kept in the idling state (in which the gear hardly rotates) so that the driving force is not transmitted. Note that it is possible to dispose a motor for rotating the tooth-lacking gear 67 as the biasing member 67*b* separately from the motor 7, so that the tooth-lacking gear 67 rotating in the pressure increasing direction engages with the gear for transmitting the driving force from the motor 7 to the tooth-lacking gear 67.

In this way, the pressing roller 12 moves between the first position (highest pressure state) and the second position (lowest pressure state).

(Stop Control Circuit 9)

Figure 8:
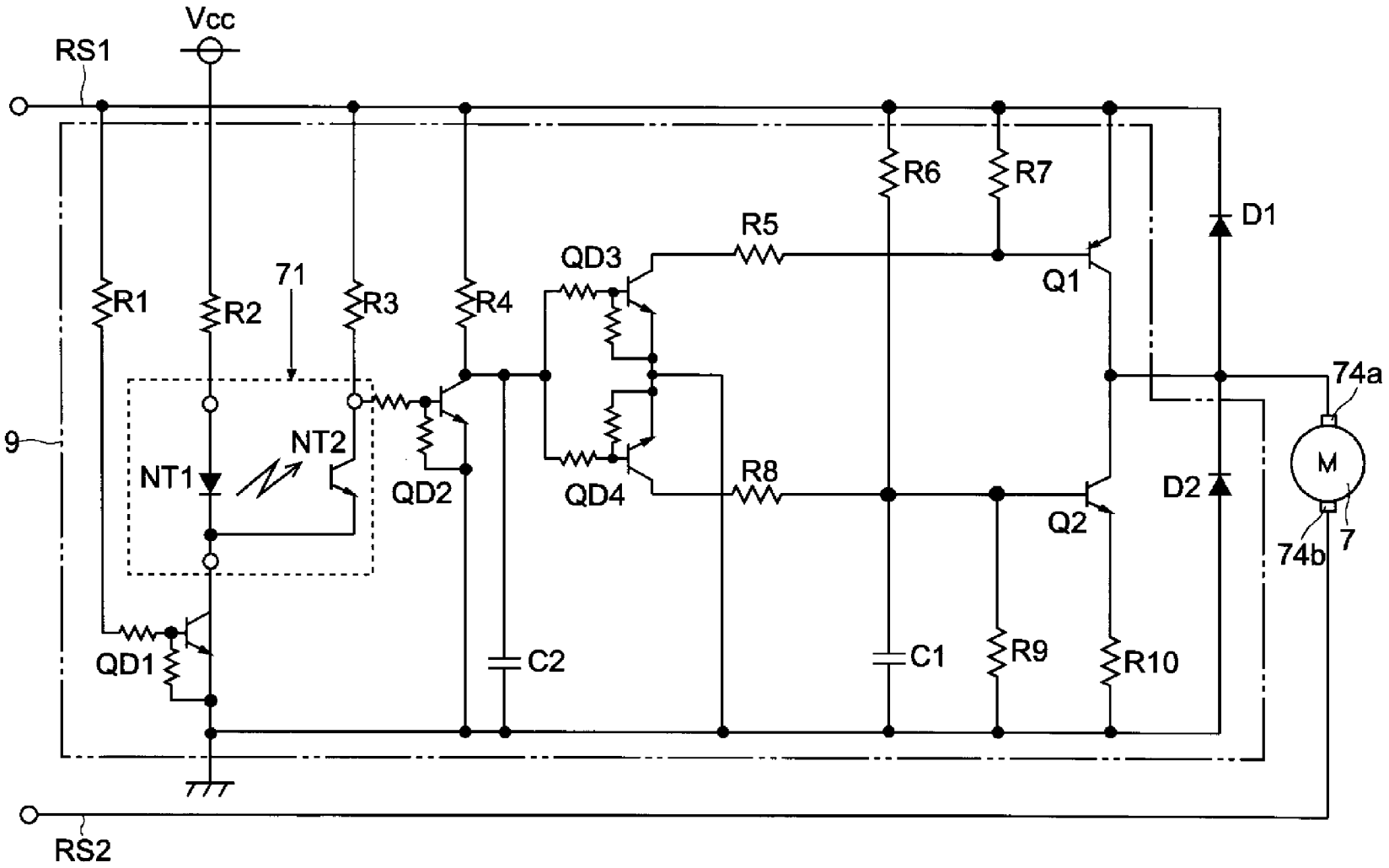
FIG. 8 is a circuit diagram illustrating an example of a stop control circuit.

Next, an example of the stop control circuit 9 according to this embodiment is described with reference to FIG. 8. FIG. 8 is a circuit diagram illustrating an example of the stop control circuit 9.

As illustrated in FIG. 8, as two signal lines from the motor drive section 8, the first signal line RS 1 is connected to the terminal 74*a* of the motor 7 while the second signal line RS2 is connected to the terminal 74*b* of the motor 7. Note that a diode D1 restricting the current direction is disposed to the first signal line RS1. The motor drive section 8 controls the direction of current supplied to the motor 7 so as to control the rotation direction of the motor 7, by connecting the first signal line RS1 to high level and the second signal line RS2 to the ground, or connecting the first signal line RS1 to the ground and the second signal line RS2 to high level, in accordance with an instruction from the engine control section 50 (engine CPU 501). For instance, the motor drive section 8 includes an H bridge circuit for switching between high and low levels of the voltage to be applied to the first signal line RS1 and the second signal line RS2 on the basis of the instruction from the engine control section 50 (engine CPU 501).

Note that in the fixing device 1 according to this embodiment, the motor drive section 8 applies the voltage to the first signal line RS1 and connects the second signal line RS2 to the ground in order to rotate the motor 7 so that the pressing roller 12 moves in the direction toward the heating roller 11 (for increasing the pressure). In addition, in order to rotate the motor 7 so that the pressing roller 12 moves in the direction separating from the heating roller 11 (for decreasing the pressure), it is necessary to rotate the motor 7 in the direction opposite to the case for increasing the pressure. Therefore, the motor drive section 8 applies the voltage to the second signal line RS2 and connects the first signal line RS1 to the ground.

Further, the stop control circuit 9 is disposed to the first signal line RS1. As illustrated in FIG. 8, the above-mentioned reach detection sensor 71 is incorporated in the stop control circuit 9. Note that a power supply voltage Vcc is supplied to the reach detection sensor 71 (for example, Vcc is 3.3V) from the power supply device 55 separately from the first signal line RS1. In addition, the stop control circuit 9 includes a plurality of resistors (R1 to R10), capacitors (C1 and C2), four digital transistors (QD1 to QD4) with incorporated resistor, two transistors (a first transistor Q1 and a second transistor Q2) for driving the motor, and a diode D2 for rectifying. Note that the first transistor Q1 and the second transistor Q2 are connected in series in the order of the first transistor Q1 and the second transistor Q2 with respect to the first signal line RS1. In this way, the stop control circuit 9 is a circuit that operates without software control.

Although details are described later, as to the first transistor Q1 and the second transistor Q2, when the motor 7 is rotated in the direction of increasing the fixing pressure, the first transistor Q1 is turned on while the second transistor Q2 is turned off during increasing the fixing pressure. Further, in the highest pressure state, the first transistor Q1 is turned off while the second transistor Q2 is turned on. In this way, the ON/OFF states of the first transistor Q1 and the second transistor Q2 are alternately switched, but the first transistor Q1 and the second transistor Q2 may be turned on at the same time due to characteristics of the transistors or a transient state of the stop control circuit 9. In addition, the first transistor Q1 and the second transistor Q2 may be turned on at the same time due to runaway of the engine CPU 501, which may instruct the motor drive section 8 to apply the voltage for driving the motor to the first signal line RS1 and the second signal line RS2 or to connect them to the ground roughly and indefinitely. Because the first transistor Q1 and the second transistor Q2 are connected in series, if they are turned on at the same time, a large transient current may flow.

Therefore, in order to prevent the first transistor Q1 and the second transistor Q2 from being turned on at the same time, the capacitor C1 for delaying the on timing of the second transistor Q2 (corresponding to the delay circuit portion) is connected to a base of the second transistor Q2. Because the second transistor Q2 is turned on after charging of the capacitor C1 is completed, it is possible to set a time difference in switching the states of the first transistor Q1 and the second transistor Q2. In addition, even if the first transistor Q1 and the second transistor Q2 are turned on at the same time, the first transistor Q1 and the second transistor Q2 are hardly broken down because there is disposed the resistor R10 for restricting current (corresponding to the current restriction circuit portion).

(Flow of Fixing Pressure Adjustment)

Figure 9:
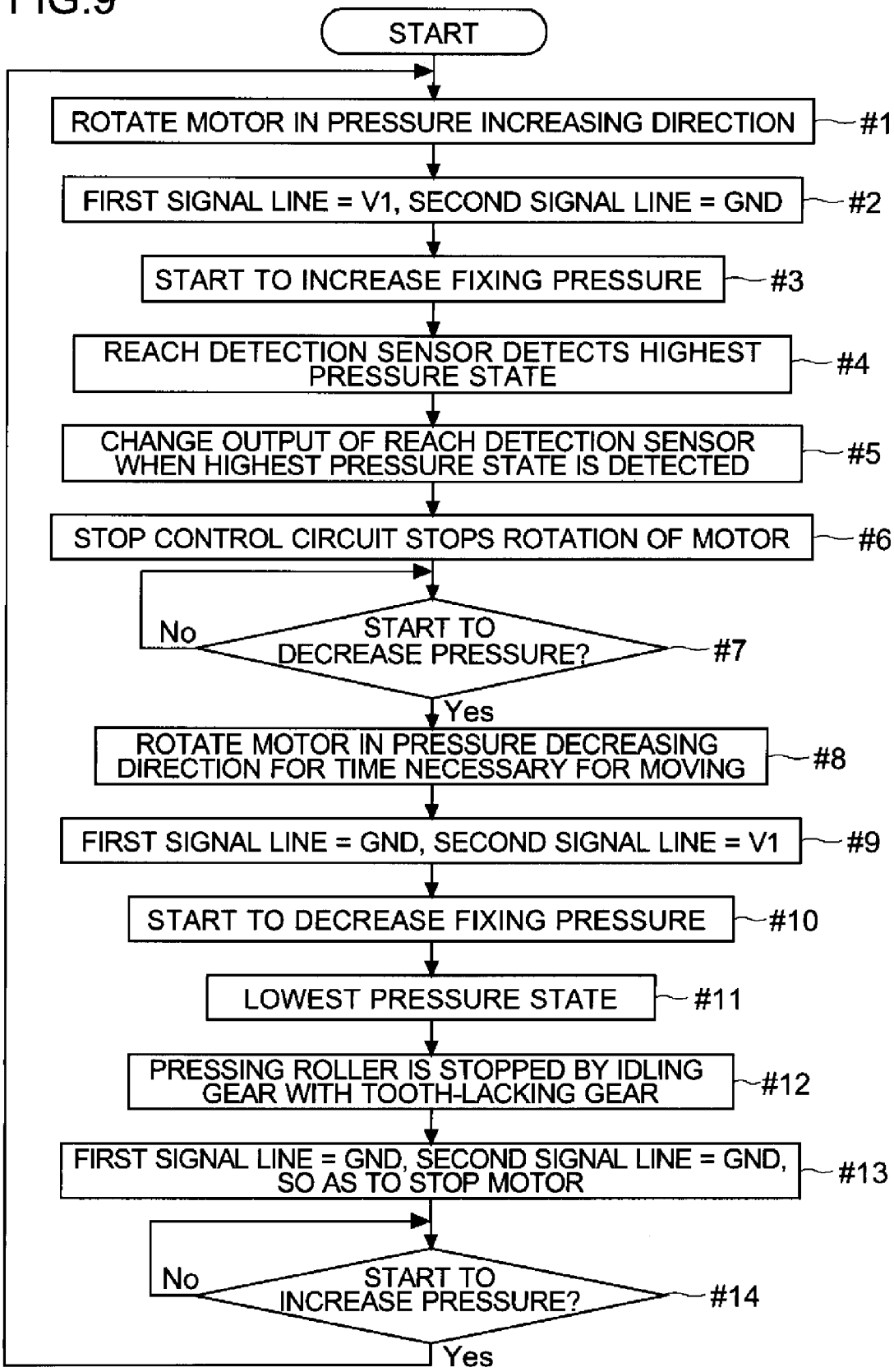
FIG. 9 is a flowchart illustrating an example of a flow of fixing pressure adjustment.
Figure 10:
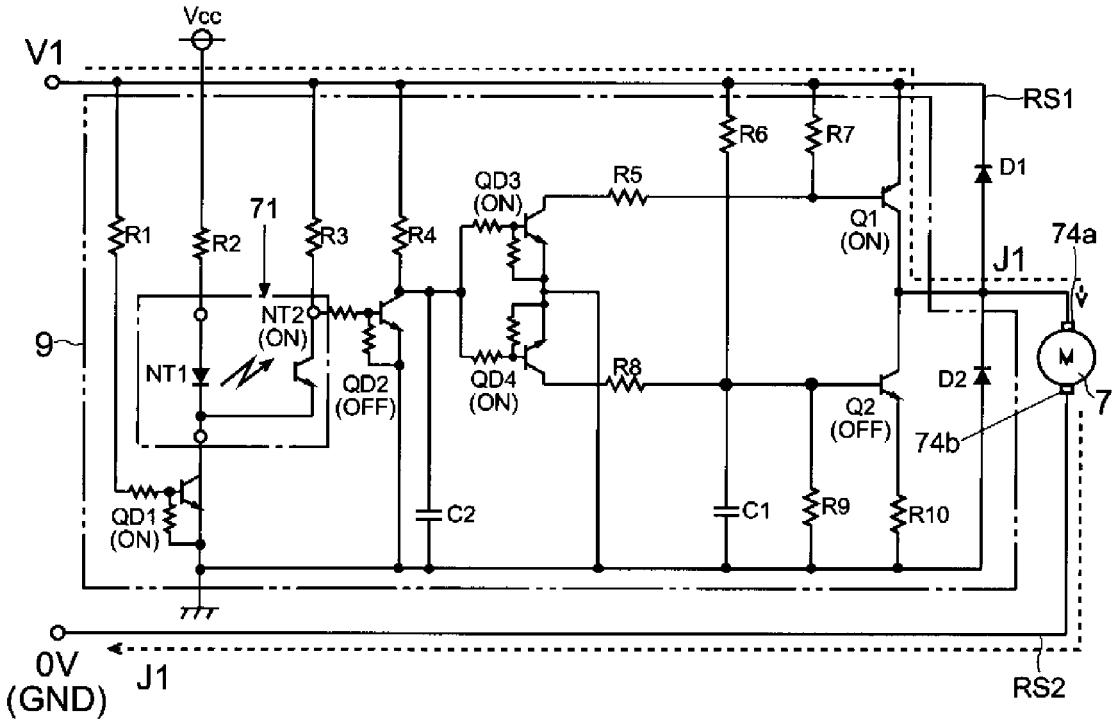
FIG. 10 is a circuit diagram for describing an action of the stop control circuit during increasing the fixing pressure.
Figure 11:
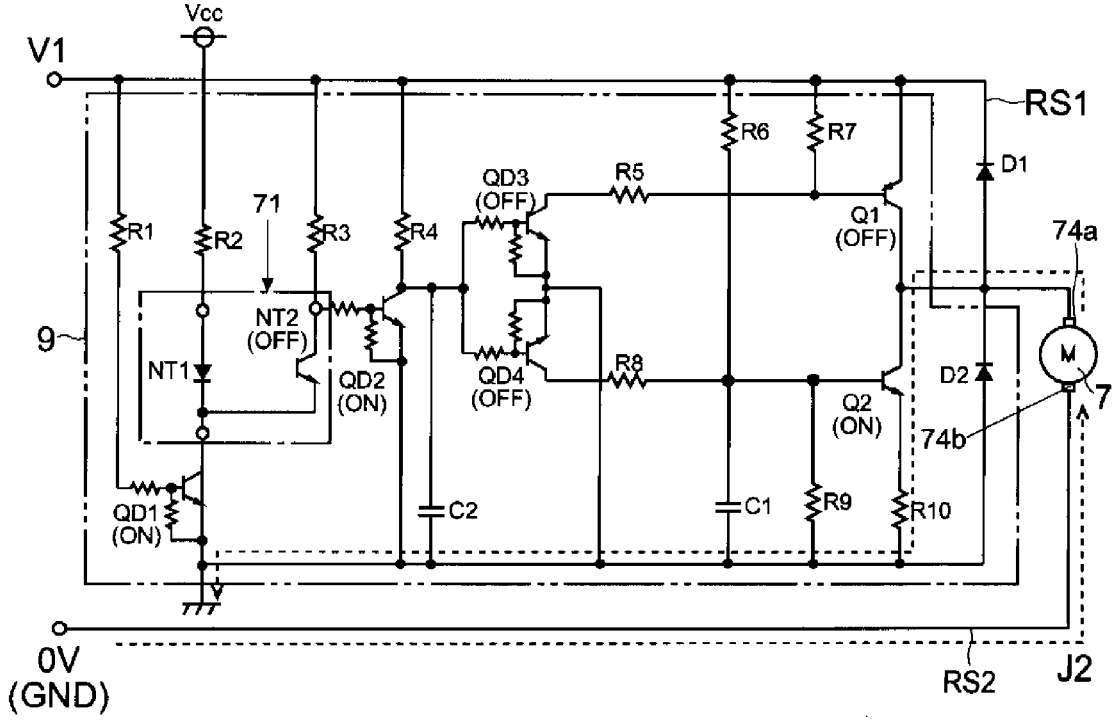
FIG. 11 is a circuit diagram for describing an action of the stop control circuit in a highest pressure state.
Figure 12:
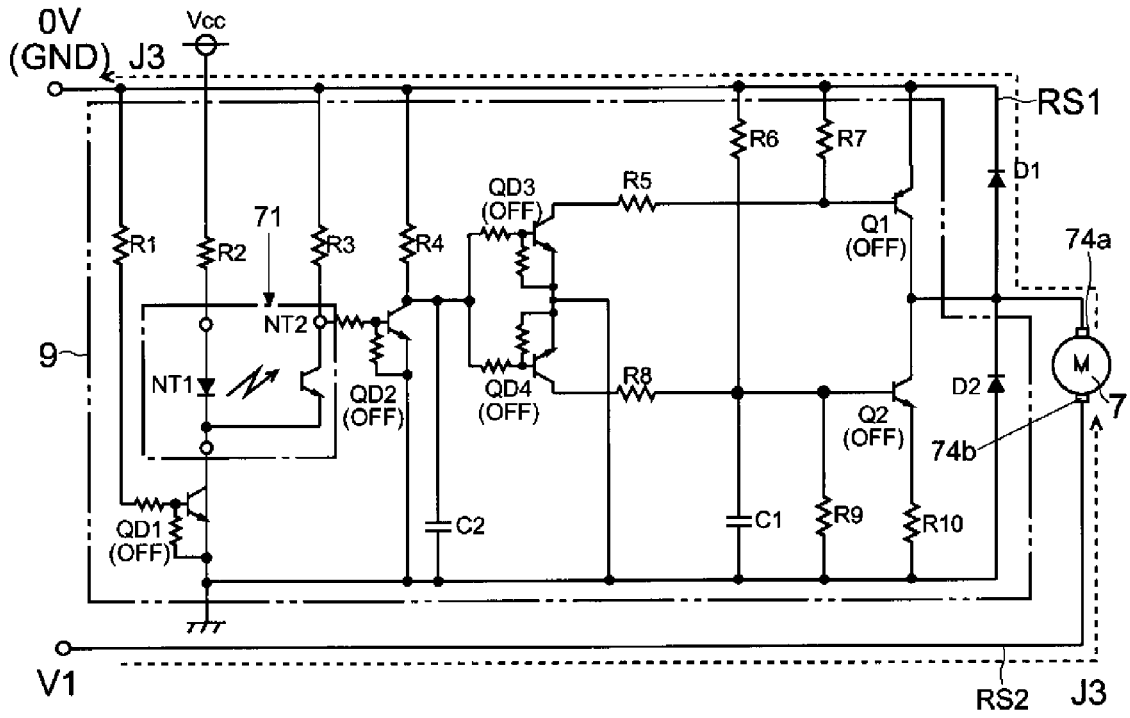
FIG. 12 is a circuit diagram for describing an action of the stop control circuit during decreasing the fixing pressure.
Figure 13:
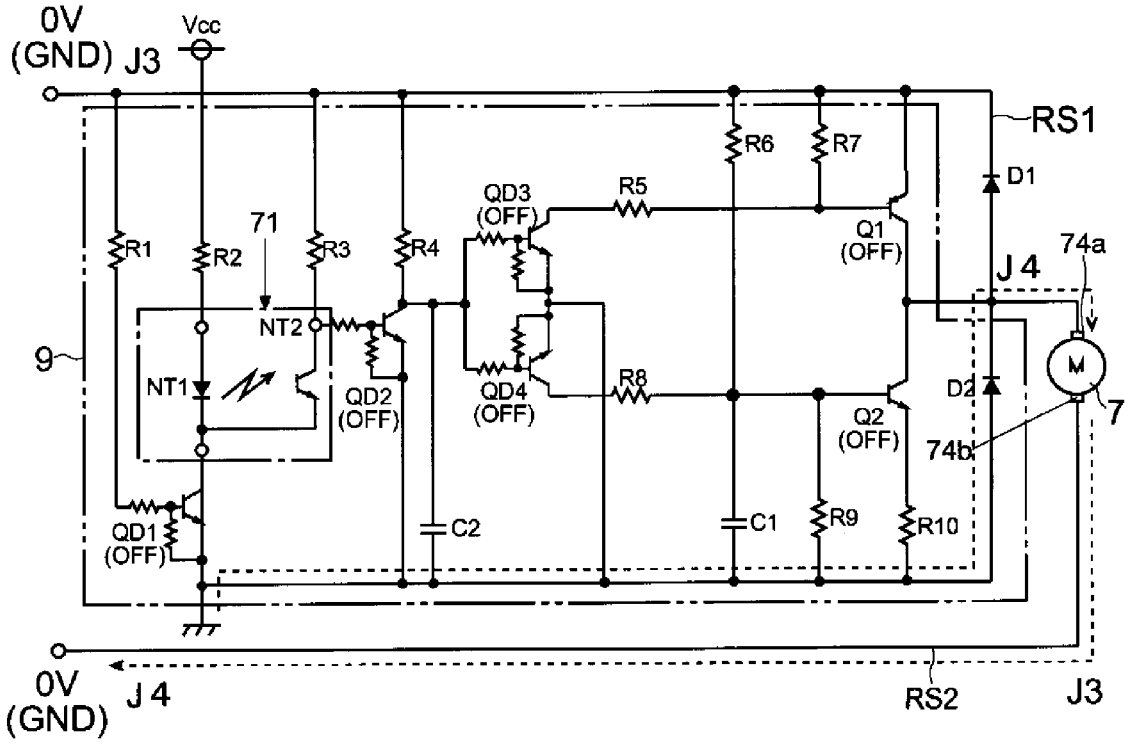
FIG. 13 is a circuit diagram for describing an action of the stop control circuit in a lowest pressure state.

Next, with reference to FIGS. 9 to 13, an example of a flow of the fixing pressure adjustment in the printer 100 of this embodiment is described. FIG. 9 is a flowchart illustrating an example of the fixing pressure adjustment. FIG. 10 is a circuit diagram for describing an action of the stop control circuit 9 during increasing the fixing pressure. FIG. 11 is a circuit diagram for describing an action of the stop control circuit 9 in the highest pressure state. FIG. 12 is a circuit diagram for describing an action of the stop control circuit 9 during decreasing the fixing pressure. FIG. 13 is a circuit diagram for describing an action of the stop control circuit 9 in the lowest pressure state.

First, the flowchart of FIG. 9 starts at the time point for pressing roller 12 to move in the direction toward the heating roller 11 so as to move the pressing roller 12 to the first position (to be the highest pressure state) when the power is turned on or when the printing is started. In other words, the flowchart starts when the pressing roller 12 is about to move from the second position to the first position (from the lowest pressure state to the highest pressure state).

In this case, the engine control section 50 (engine CPU 501) issues an instruction to the motor drive section 8 to rotate the motor 7 in the direction for moving the pressing roller 12 toward the heating roller 11 (in the pressure increasing direction) (Step #1).

Receiving this instruction, the motor drive section 8 applies a voltage V1 for driving the motor (for example, DC 24 V generated by the power supply device 55) to the first signal line RS 1 and connects the second signal line RS2 to the ground (Step #2). Thus, the pressing roller 12 starts to move in the direction toward the heating roller 11 so as to start to increase the fixing pressure (Step #3). Note that when the pressing roller 12 is moved in the direction from the second position to the first position (in the direction toward the heating roller 11), the above-mentioned biasing member 67*b* permits the tooth-lacking gear 67 to engage with the gear of the gear train 63 for transmitting the driving force to the tooth-lacking gear 67 so that the idling state is released.

With reference to FIG. 10, the action (state) of the stop control circuit 9 during increasing the fixing pressure is described. During increasing the fixing pressure, the motor drive section 8 applies the DC voltage V1 for driving the motor to the first signal line RS1 and connects the second signal line RS2 to GND. During increasing the fixing pressure, the light emitted from the light emission portion NT1 of the reach detection sensor 71 is not blocked, and hence the light reception portion NT2 of the reach detection sensor 71 is turned on, until the pressing roller 12 becomes the first position (in the highest pressure state).

Then, the digital transistor QD1 is turned on, the digital transistor QD2 is turned off, the digital transistor QD3 is turned on, and the digital transistor QD4 is turned on. The first transistor Q1 is a pnp type, and the second transistor Q2 is an npn type. Therefore, the first transistor Q1 is turned on, and the second transistor Q2 is turned off. Thus, current J1 flows in the direction illustrated by a broken line in FIG. 10, and hence the motor 7 rotates.

Along with continuous increase of the fixing pressure, the reach detection sensor 71 soon detects that the position of the pressing roller 12 reaches the first position (becomes the highest pressure state) (Step #4). An output change of the reach detection sensor 71 due to detection of the highest pressure state is supplied to the stop control circuit 9 (Step #5), and the stop control circuit 9 stops rotation of the motor 7 (Step #6).

With reference to FIG. 11, an action (state) of the stop control circuit 9 in the highest pressure state of the fixing pressure is described. Even in the highest pressure state, unless decreasing of the pressure is started, the motor drive section 8 applies the DC voltage V1 for driving the motor to the first signal line RS1 and connects the second signal line RS2 to the GND. In the highest pressure state, the light emitted by the light emission portion NT1 of the reach detection sensor 71 is blocked, and hence the light reception portion NT2 of the reach detection sensor 71 is turned off.

Then, the digital transistor QD1 is turned on, the digital transistor QD2 is turned on, the digital transistor QD3 is turned off, and the digital transistor QD4 is turned off. Thus, the first transistor Q1 is turned off, and the second transistor Q2 is turned on. Thus, the voltage V1 is not applied to either one of the terminals 74*a* and 74*b* of the motor 7 (both terminals become the GND level), and hence the rotation of the motor 7 is stopped. Thus, the motor 7 does not become the locked state, and a large force is not applied to gear train 63 continuously. Further, because a collector of the second transistor Q2 is connected to the terminal 74*a* to which the voltage V1 for driving the motor 7 has been applied, current J2 due to counter electromotive force (illustrated by a broken line in FIG. 11) flowing until the motor 7 stops can flow toward the GND through the turned-on second transistor Q2.

Note that due to runaway, in the highest pressure state, the engine control section 50 (engine CPU 501) may issue the instruction to the motor drive section 8 to apply the voltage V1 for driving the motor to both the first signal line RS 1 and the second signal line RS2. When the motor drive section 8 receives this instruction and applies voltage V1 to both the first signal line RS1 and the second signal line RS2, if the reach detection sensor 71 is in the light-blocked state, the transistor Q2 is turned on (to be the same state as in FIG. 11). Therefore, the current flows in the motor 7 to rotate in the pressure decreasing direction. Then, the metal plate 72 soon becomes not to block the light of the reach detection sensor 71, and hence the transistor Q2 is turned off (to be the same state as in FIG. 10). Then, the same voltage V1 is applied to the terminals 74*a* and 74*b* of the motor 7, and hence the motor 7 is stopped. Therefore, the stop control circuit 9 acts so that the same voltage is applied to the terminals 74*a* and 74*b* of the motor 7 so as to stop the motor 7 even if the first signal line RS1 and the second signal line RS2 become high level (even if the DC voltage is applied). In this way, even if the engine control section 50 (engine CPU 501) runs away so as to apply the voltage V1 to both the first signal line RS1 and the second signal line RS2, the stop control circuit 9 keeps the motor 7 in the stop state, and thus the motor 7 or a gear of the fixing pressure adjustment mechanism 6 are not broken down.

Note that even if the engine control section 50 (engine CPU 501) runs away so as to apply the voltage V 1 to the first signal line RS1 and to connect the second signal line RS2 to the GND, the motor 7 continues to stop as described above. In addition, even if the engine control section 50 (engine CPU 501) runs away to control the motor drive section 8 to connects the first signal line RS1 to the GND and to apply the voltage V1 to the second signal line RS2, only the decreasing of the pressure starts. When the first signal line RS1 is connected to the GND and the second signal line RS2 is connected to the GND, power supply to the motor 7 is stopped, and hence the motor 7 continues the stop state.

Then, when the fixing pressure becomes the highest pressure state (when the pressing roller 12 becomes the first position), the engine control section 50 (engine CPU 501) checks whether or not to start to decrease the pressure (Step #7). A condition (trigger) to start to decrease the pressure is determined in advance and can be arbitrarily determined The engine control section 50 (engine CPU 501) may start to decrease the pressure on the condition that the printing is completed or that a predetermined time has passed without performing the printing after the warming up.

The engine control section 50 (engine CPU 501) continues to check until the condition to start to decrease the pressure is satisfied (No in Step #7 to Step #7). Then, when the condition to start to decrease the pressure is satisfied (Yes in Step #7), the engine control section 50 (engine CPU 501) issues the instruction to the motor drive section 8 to rotate the motor 7 (in the pressure decreasing direction) for a period of time necessary for moving, so as to move the pressing roller 12 in the direction separating from the heating roller 11 (in the direction to the second position) (Step #8). Here, the time necessary for moving is longer than time sufficient for moving the pressing roller 12 from the first position to the second position by rotating the motor 7 with a margin. For instance, if approximately four seconds are necessary for moving the pressing roller 12 from the first position to the second position, the time necessary for moving is set to approximately six seconds.

When receiving this instruction, the motor drive section 8 connects the first signal line RS1 to the ground and applies the voltage V1 for driving the motor (for example, DC 24 V generated by the power supply device 55) to the second signal line RS2 (Step #9). Thus, the motor 7 starts to rotate in the direction such that the pressing roller 12 moves in the direction separating from the heating roller 11, the pressing roller 12 moves toward the second position, and the decreasing of the fixing pressure is started (Step #10).

Note that if the flow from the increasing pressure state via the highest pressure state to the start of decreasing the pressure is rapid (if the first signal line RS1 is abruptly connected to the ground while the voltage V1 is abruptly applied to the second signal line RS2 from the state where the voltage V1 is applied to the first signal line RS1 while the second signal line RS2 is connected to the ground), the first transistor Q1 and the second transistor Q2 may be turned on at the same time. As a result, a large current flows through the first transistor Q1 and the second transistor Q2 so that the first transistor Q1 or the second transistor Q2 may break down. Therefore, when the instruction to switch rotation direction of the motor 7 is issued, the engine control section 50 (engine CPU 501) may issue an instruction to the motor drive section 8 to connect both the first signal line RS1 and the second signal line RS2 to the ground and then may issue the instruction for application of the voltage and connection to the ground for the first signal line RS1 and the second signal line RS2. By connecting both the first signal line RS1 and the second signal line RS2 to the ground, the circuit state is reset, and it is possible to prevent the first transistor Q1 and the second transistor Q2 from being turned on at the same time.

With reference to FIG. 12, the action (state) of the stop control circuit 9 during decreasing the fixing pressure is described. During decreasing the pressure, the motor drive section 8 applies the DC voltage V1 for driving the motor to the second signal line RS2, and the first signal line RS1 is connected to the GND. During decreasing the pressure, the voltage V1 is not applied to the stop control circuit 9 in the forward bias direction for either one of the transistors. The digital transistors QD1 to QD4, the first transistor Q1, and the second transistor Q2 are all turned off. In other words, the stop control circuit 9 is connected to the first signal line RS 1 and works when the voltage is applied to the first signal line RS 1 while it does not operate (work) when the voltage is not applied to the first signal line RS1 so as not to be connected to the second signal line RS2. Then, current J3 flows from the second signal line RS2 in the direction to the first signal line RS 1 via the motor 7 (as illustrated by a broken line in FIG. 12) so that the motor 7 rotates in the pressure decreasing direction (the current flows in the opposite direction to the case of increasing the pressure). Note that the reach detection sensor 71 does not work because the digital transistor QD1 is turned off When the pressure is decreased, the position of the pressing roller 12 reaches the second position to be the lowest pressure state (Step #11). Note that it is not necessary to detect being the lowest pressure state by a special sensor. Then, when the pressing roller 12 reaches the second position, the gear for transmitting the driving force to the tooth-lacking gear 67 becomes the idling state due to the tooth-lacking gear 67 included in the fixing pressure adjustment mechanism 6, and hence the pressing roller 12 is stopped (Step #12). Thus, even in the lowest pressure state, the motor 7 does not become the locked state, and hence a large force is not applied to the gear train 63 continuously.

Further, in decreasing the pressure, the engine control section 50 (engine CPU 501) has issued the instruction to the motor drive section 8 to rotate the motor 7 for the time necessary for moving. Therefore, after the time necessary for moving passes from the start of driving the motor 7, the motor drive section 8 stops the motor 7 by connecting the first signal line RS1 to the GND and connecting the second signal line RS2 to the GND (Step #13).

With reference to FIG. 13, there is described an action (state) of the stop control circuit 9 when the motor 7 is stopped in the lowest pressure state of the fixing pressure (in which the pressing roller 12 is in the second position). When the motor 7 is stopped in the lowest pressure state, the motor drive section 8 connects the first signal line RS1 and the second signal line RS2 to the GND. Because the stop control circuit 9 does not operate (work) unless the voltage is applied to the first signal line RS1, the state of the stop control circuit 9 is the same as during decreasing the pressure as described above with reference to FIG. 12.

In addition, because the terminals 74*a* and 74*b* of the motor 7 become the same potential, rotation of the motor 7 is stopped. Then, current J4 (illustrated by a broken line in FIG. 13) that flows due to the counter electromotive force until the motor 7 stops can flow to the GND through the diode D2, for example.

Then, when the fixing pressure becomes the lowest pressure state (when the pressing roller 12 becomes the second position), the engine control section 50 (engine CPU 501) checks whether or not to start to increase the pressure (Step #14). The condition (trigger) to start to increase the pressure is determined in advance and can be arbitrarily determined For instance, the engine control section 50 (engine CPU 501) may start to increase the pressure when the main power supply is turned on, or when restoring from a power saving mode, or on the condition that the printer 100 receives the instruction to start printing and print data and from the computer 200.

The engine control section 50 (engine CPU 501) continues to check whether or not the condition to start to increase the pressure is satisfied (No in Step #14 to Step #14). When the condition to start to increase the pressure is satisfied (Yes in Step #14), the flow goes back to Step #1.

In this way, the fixing device 1 of this embodiment includes the heating rotating member (heating roller 11), the pressing rotating member (pressing roller 12), the motor 7, the fixing pressure adjustment mechanism 6, the control section (engine control section 50), the motor drive section 8, the detecting member (reach detection sensor 71), and the stop control circuit 9. The heating rotating member heats the paper sheet onto which the toner is transferred. The pressing rotating member is pressed to the heating rotating member to form the nip. The motor 7 can rotate in forward and backward directions. The fixing pressure adjustment mechanism 6 is driven by the motor 7 and moves the rotating member to be moved that is one of the heating rotating member and the pressing rotating member (pressing roller 12 in this embodiment) in the pressure increasing direction and in the pressure decreasing direction between predetermined first and second positions in accordance with the rotation direction of the motor 7, so as to adjust the fixing pressure as the nip pressure. The control section includes the control device (engine CPU 501), and the control device issues the instruction of the voltage to be applied to the motor 7 in accordance with the rotation direction of the motor 7 by software control. The motor drive section 8 controls the voltage to be applied to the motor 7 on the basis of the instruction from the control section. The detecting member detects that the rotating member to be moved that has been moved by the fixing pressure adjustment mechanism 6 reaches the first position and inhibits the output from being received by the control device. The stop control circuit 9 receives an output of the detecting member. When the detecting member detects that the rotating member to be moved reaches the first position, the stop control circuit 9 stops the motor 7 without software control.

Thus, the output of the detecting member (reach detection sensor 71) is supplied to the stop control circuit 9 instead of the control section (engine control section 50), and the stop control circuit 9 can stop the motor 7 at the same time as the rotating member to be moved (pressing roller 12 in this embodiment) reaches the first position. Therefore, instead of software control by the control device such as the CPU (engine CPU 501), the extra stop control circuit 9 can stop the motor 7. In addition, because the stop control circuit 9 different from the control device stops the motor 7, even if the control device such as the CPU runs away, the motor 7 can be securely stopped. Therefore, it is possible to prevent a breakdown of the motor 7 or a component such as the gear for transmitting the drive force from the motor 7. In addition, because the control device such as the CPU is not required to receive the output of the sensor, the number of ports of the control device can be reduced. Therefore, it is not necessary to increase a size of the substrate on which the control device such as the CPU is mounted, and wiring in the apparatus can be simplified. In addition, it is not necessary to include complicated software for rotation control of the motor 7 in the control device such as the CPU.

In addition, the fixing pressure adjustment mechanism 6 includes the gear train 63 for transmitting the driving force from the motor 7. The gear train 63 includes the tooth-lacking gear 67 arranged to stop the rotating member to be moved by idling the gear for transmitting the driving force when the rotating member to be moved (pressing roller 12 in this embodiment) reaches the second position. When moving the rotating member to be moved in the direction toward the second position, the control section (engine control section 50) issues the instruction to the motor drive section 8 to rotate the motor 7 for a predetermined time necessary for moving in the direction corresponding to the moving direction of the rotating member to be moved to the second position. The time necessary for moving is set to be longer than the time necessary for moving the rotating member to be moved from the first position to the second position. Thus, when the rotating member to be moved reaches the second position, even if the motor 7 continues to rotate, a large load is not applied on each gear, and the motor 7 does not become the locked state. Therefore, it is possible to prevent a breakdown of a component such as the gear or the motor 7. In addition, the control section can securely stop the rotating member to be moved at the second position by issuing the instruction to rotate the motor 7 for the time necessary for moving (the engine control section 50 is required only to perform time control).

In addition, the motor 7 has two terminals 74*a* and 74*b*. The terminal 74*a* is connected to the first signal line RS1, and the other terminal 74*b* is connected to the second signal line RS2. The first signal line RS1 and the second signal line RS2 are connected to the motor drive section 8. When the motor 7 is rotated in the direction for moving the rotating member to be moved (pressing roller 12 in this embodiment) toward the first position, the motor drive section 8 applies the voltage to the first signal line RS1 and connects the second signal line RS2 to the ground. When the motor 7 is rotated in the direction corresponding to the moving direction of the rotating member to be moved toward the second position, the motor drive section 8 connects the first signal line RS1 to the ground and applies the voltage to the second signal line RS2. The stop control circuit 9 is connected to the first signal line RS1, works when the voltage is applied to the first signal line RS1, and is not connected to the second signal line RS2. Thus, only when moving the rotating member to be moved toward the first position, the stop control circuit 9 can work. While moving the rotating member to be moved toward the second position, it is possible to stop the stop control circuit 9. Therefore, compared with the case where the stop control circuit 9 is disposed to each of the first signal line RS1 and the second signal line RS2, the circuit structure of the stop control circuit 9 can be simplified. In addition, power consumption can be reduced.

In addition, the stop control circuit 9 includes the first transistor Q1 connected to the first signal line RS1 and the second transistor Q2 connected to the first transistor Q1 in series with respect to the first signal line RS1. The first transistor Q1 is turned on in the period until the rotating member to be moved (pressing roller 12 in this embodiment) reaches the first position, so as to apply the voltage to the motor 7 to rotate in the direction corresponding to the moving direction of the rotating member to be moved toward the first position. When the detecting member (reach detection sensor 71) detects that the rotating member to be moved reaches the first position, the first transistor Q1 is turned off so as to stop applying the voltage to the motor 7. When the first transistor Q1 is turned off, the second transistor Q2 is turned on so as to permit the current to flow when the motor 7 is stopped. Therefore, the stop control circuit 9 can be simply constituted using the transistors. In addition, using the first transistor Q1 and the second transistor Q2, it is possible to appropriately permit the current to flow in the motor 7.

In addition, the stop control circuit 9 includes the delay circuit portion (capacitor C1) for delaying the on-timing of the second transistor Q2 so that the first transistor Q1 and the second transistor Q2 are not turned on at the same time, and the current restriction circuit portion (resistor R10) for restricting current when the first transistor Q1 and the second transistor Q2 become turned on at the same time. Although the serial circuit of the first transistor Q1 and the second transistor Q2 is connected to the first signal line RS1, it is possible to avoid by the delay circuit portion that both the first transistor Q1 and the second transistor Q2 are temporarily turned on. Thus, it is possible to prevent a large current from flowing in the first transistor Q1 and the second transistor Q2 resulting in a breakdown of each transistor. In addition, even if both the first transistor Q1 and the second transistor Q2 are temporarily turned on, the current restriction circuit portion can prevent a large current from flowing in the first transistor Q1 and the second transistor Q2 resulting in a breakdown of each transistor.

In addition, when issuing the instruction to switch the rotation direction of the motor 7, the control section (engine control section 50) issues the instruction to the motor drive section 8 to connect the first signal line RS1 and the second signal line RS2 to the ground, and then issues the instruction for the voltage application and connection to the ground for the first signal line RS1 and the second signal line RS2. Thus, it is possible to reset the state of the stop control circuit 9 and to securely avoid that both the first transistor Q1 and the second transistor Q2 are turned on due to the transient state of the circuit.

In addition, a plurality of gears of the fixing pressure adjustment mechanism 6 includes the worm gear 64. As to the worm gear 64 constituted of the worm 65 and the worm wheel 66, because the worm wheel 66 usually cannot turn the worm 65, a force from the fixing pressure adjustment mechanism 6 cannot reversely rotate the motor 7. Therefore, even if a force is applied so that the rotating member to be moved (pressing roller 12 in this embodiment) moves back in the direction toward the position before the movement, the rotating member to be moved cannot move. For instance, the position of the rotating member to be moved after moving in the pressure increasing direction cannot be shifted, and the fixing pressure can be maintained at a constant pressure so that the fixing of toner can be appropriately performed.

In addition, the first position is the position of the rotating member to be moved (pressing roller 12 in this embodiment) in the highest pressure state where the heating rotating member (heating roller 11) and the pressing rotating member (pressing roller 12) are pressed to each other to make a predetermined fixing pressure, or the position of the rotating member to be moved in the lowest pressure state where the rotating members are separated farthest. When the first position is the position of the rotating member to be moved in the highest pressure state, the second position is the position of the rotating member to be moved in the lowest pressure state. When the first position is the position of the rotating member to be moved in the lowest pressure state, the second position is the position of the rotating member to be moved in the highest pressure state. In this way, the stop control of the motor 7 by the stop control circuit 9 can be applied to the case where the lowest pressure state is changed to the highest pressure state and to the case where the highest pressure state is changed to the lowest pressure state.

In addition, the fixing pressure adjustment mechanism 6 includes the contact plate 61 and the cam 62 that is rotated by the motor 7. The contact plate 61 can swing, and has the surface contacting with the rotation shaft 12*a* of the rotating member to be moved (pressing roller 12 in this embodiment) and the other surface contacting with the cam 62. The cam 62 rotates to move the contact plate 61 and the rotating member to be moved that contacts with the contact plate 61. Thus, the fixing pressure between the heating rotating member (heating roller 11) and the pressing rotating member 12 can be adjusted by the simple structure.

In addition, the image forming apparatus (for example, printer 100) includes the above-mentioned fixing device 1. With this structure, even if the control device such as the CPU (engine CPU 501) runs away, the motor 7 can securely stop. Thus, it is possible to provide the image forming apparatus including the fixing device 1 without the demerit due to software control performed by the control device such as the CPU.

In addition, the present disclosure can also be regarded as a method.

Next, another embodiment is described. In the above-mentioned embodiment, it is described that the first position is the position in which the pressing roller 12 is close to the heating roller 11 (pressure increased position), and that the second position is the position in which the pressing roller 12 is separated from the heating roller 11 (pressure decreased position). However, on the contrary to the above description, it is possible that the first position is the position in which the pressing roller 12 is separated from the heating roller 11, and the second position is the position in which the pressing roller 12 is close to the heating roller 11.

Although the embodiments of the present disclosure are described above, the scope of the present disclosure is not limited to the embodiments. The present disclosure can be embodied with various modifications without deviating from the spirit of the disclosure.

What is claimed is:

1. A fixing device comprising:

a heating rotating member for heating a paper sheet to which toner is transferred;

a pressing rotating member which is pressed to the heating rotating member so as to form a nip;

a motor which is rotatable in forward and backward directions;

a fixing pressure adjustment mechanism which is driven by the motor and moves a rotating member to be moved as one of the heating rotating member and the pressing rotating member in a pressure increasing direction and in a pressure decreasing direction between predetermined first and second positions, in accordance with a rotation direction of the motor, so as to adjust a fixing pressure as a pressure of the nip;

a control section including a control device which issues an instruction of voltage to be applied to the motor by software control in accordance with the rotation direction of the motor;

a motor drive section which controls the voltage to be applied to the motor on the basis of the instruction from the control section;

a detecting member which detects that the rotating member to be moved that has been moved by the fixing pressure adjustment mechanism reaches the first position and which is not connected to the control device; and a stop control circuit which receives an output of the detecting member and stops the motor without software control when the detecting member detects that the rotating member to be moved reaches the first position, wherein the motor has at least two terminals, one of which is connected to a first signal line while the other terminal is connected to a second signal line, the first signal line and the second signal line are connected to the motor drive section, when the motor drive section rotates the motor in a direction such that the rotating member to be moved is directed to the first position, the motor drive section applies a voltage to the first signal line and connects the second signal line to the ground, when the motor drive section rotates the motor in a direction such that the rotating member to be moved is directed to the second position, the motor drive section connects the first signal line to the ground and applies a voltage to the second signal line, the stop control circuit is connected to the first signal line, works when a voltage is applied to the first signal line, and is not connected to the second signal line, the stop control circuit includes a first transistor connected to the first signal line and a second transistor connected to the first transistor in series with respect to the first signal line, the first transistor is turned on until the rotating member to be moved reaches the first position, so as to apply a voltage to the motor to rotate in the direction such that the rotating member to be moved is directed to the first position, and is turned off to stop to apply the voltage to the motor when the detecting member detects that the rotating member to be moved reaches the first position, and the second transistor becomes turned on when the first transistor is turned off, so as to permit current to flow when the motor stops.

2. The fixing device according to claim 1, wherein the fixing pressure adjustment mechanism includes a gear train for transmitting a driving force from the motor, the gear train includes a tooth-lacking gear arranged so that a gear for transmitting the driving force idles to stop the rotating member to be moved when the rotating member to be moved reaches the second position, when the control section moves the rotating member to be moved in a direction toward the second position, the control section issues an instruction to the motor drive section to rotate the motor for a predetermined time necessary for moving in a direction corresponding to the moving direction of the rotating member to be moved toward the second position, and the time necessary for moving is longer than a time after the rotating member starts to be moved from the first position until the tooth-lacking gear causes the rotating member to stop at the second position.

3. The fixing device according to claim 1, wherein the stop control circuit includes a delay circuit portion for delaying the on-timing of the second transistor so that the first transistor and the second transistor are not turned on at the same time, and a current restriction circuit portion for restricting current when the first transistor and the second transistor are turned on at the same time.

4. The fixing device according to claim 1, wherein when the control section issues an instruction to switch the rotation direction of the motor, the control section issues an instruction to the motor drive section to connect the first signal line and the second signal line to the ground and then issues an instruction for the voltage application and connection to the ground for the first signal line and the second signal line.

5. The fixing device according to claim 2, wherein the gear train of the fixing pressure adjustment mechanism includes a worm gear.

6. The fixing device according to claim 1, wherein the first position is a position of the rotating member to be moved in a highest pressure state in which the heating rotating member and the pressing rotating member are pressed to each other so as to make a predetermined fixing pressure, or a position of the rotating member to be moved in a lowest pressure state in which the heating rotating member and the pressing rotating member are separated farthest from each other, and the second position is the position of the rotating member to be moved in the lowest pressure state when the first position is the position of the rotating member to be moved in the highest pressure state, and is the position of the rotating member to be moved in the highest pressure state when the first position is the position of the rotating member to be moved in the lowest pressure state.

7. The fixing device according to claim 1, wherein the fixing pressure adjustment mechanism includes a contact plate and a cam rotated by the motor, the contact plate can swing, and has a surface contacting with a rotation shaft of the rotating member to be moved and the other surface contacting with the cam, and the cam rotates so as to move the contact plate and the rotating member to be moved that contacts with the contact plate.

8. An image forming apparatus comprising the fixing device according to claim 1.

9. A method for controlling a fixing device, the method comprising the steps of:

permitting the heating rotating member to heat a paper sheet onto which toner is transferred;

pressing a pressing rotating member to the heating rotating member so as to form a nip;

moving a rotating member to be moved that is one of the heating rotating member and the pressing rotating member, between predetermined first and second positions in a pressure increasing direction and in a pressure decreasing direction, on the basis of driving a motor that can rotate in forward and backward directions, in accordance with a rotation direction of the motor, so as to permit the fixing pressure adjustment mechanism to adjust a fixing pressure that is a pressure of the nip;

permitting a control section including a control device to issue an instruction of a voltage to be applied to the motor by software control in accordance with the rotation direction of the motor;

permitting the motor drive section to control the voltage to be applied to the motor on the basis of the instruction from the control section;

not connecting an output of a detecting member for detecting that the rotating member to be moved that has been moved by the fixing pressure adjustment mechanism reaches the first position to the control device;

supplying the output of the detecting member to the stop control circuit;

permitting the stop control circuit to stop the motor without software control, when the detecting member detects that the rotating member to be moved reaches the first position;

connecting one of the terminals of the motor to a first signal line, and connecting the other terminal to a second signal line;

connecting the motor drive section to the first signal line and the second signal line;

controlling the motor drive section to apply a voltage to the first signal line and to connect the second signal line to the ground when rotating the motor in a direction such that the rotating member to be moved is directed to the first position;

controlling the motor drive section to connect the first signal line to the ground and to apply a voltage to the second signal line when rotating the motor in a direction such that the rotating member to be moved is directed to the second position;

connecting the first signal line to the stop control circuit and permitting the stop control circuit to work when a voltage is applied to the first signal line;

inhibiting the stop control circuit from being connected to the second signal line;

connecting the first signal line to a first transistor included in the stop control circuit;

connecting a second transistor to the first transistor in series with respect to the first signal line;

turning on the first transistor to apply a voltage to the motor to rotate in a direction such that the rotating member to be moved is directed to the first position in a period while moving the rotating member to be moved until reaching the first position;

turning off the first transistor to stop to apply the voltage to the motor when the detecting member detects that the rotating member to be moved reaches the first position; and turning on the second transistor when the first transistor is turned off in order to permit current to flow when the motor is stopped.

10. The method for controlling a fixing device according to claim 9, further comprising:

adapting a gear train of the fixing pressure adjustment mechanism for transmitting a driving force from the motor to include a tooth-lacking gear arranged so that a gear for transmitting the driving force idles to stop the rotating member to be moved when the rotating member to be moved reaches the second position;

applying an instruction to the motor drive section to rotate the motor for a predetermined time necessary for moving in a direction corresponding to the moving direction of the rotating member to be moved toward the second position when moving the rotating member to be moved in a direction toward the second position; and setting the time necessary for moving to be longer than a time after the rotating member starts to be moved from the first position until the tooth-lacking gear causes the rotating member to stop at the second position.

11. The method for controlling a fixing device according to claim 9, further comprising:

delaying the on-timing of the second transistor so that the first transistor and the second transistor are not turned on at the same time; and restricting current when the first transistor and the second transistor are turned on at the same time.

12. The method for controlling a fixing device according to claim 9, further comprising issuing an instruction to connect the first signal line and the second signal line to the ground, and then issuing an instruction for the voltage application and connection to the ground for the first signal line and the second signal line when issuing an instruction to the motor drive section to switch the rotation direction of the motor.

13. The method for controlling a fixing device according to claim 10, further comprising using a worm gear for the gear train of the fixing pressure adjustment mechanism.

14. The method for controlling a fixing device according to claim 9, wherein the first position is a position of the rotating member to be moved in a highest pressure state in which the heating rotating member and the pressing rotating member are pressed to each other so as to make a predetermined fixing pressure, or a position of the rotating member to be moved in a lowest pressure state in which the heating rotating member and the pressing rotating member are separated farthest from each other, and the second position is the position of the rotating member to be moved in the lowest pressure state when the first position is the position of the rotating member to be moved in the highest pressure state, and is the position of the rotating member to be moved in the highest pressure state when the first position is the position of the rotating member to be moved in the lowest pressure state.

15. The method for controlling a fixing device according to claim 9, further comprising:

permitting one of surfaces of a contact plate capable of swinging to contact with a rotation shaft of the rotating member to be moved and the other surface to contact with the cam; and rotating the cam so as to move the contact plate and the rotating member to be moved that contacts with the contact plate.

* * * * *